US007414528B2

(12) United States Patent
Crichton

(10) Patent No.: US 7,414,528 B2
(45) Date of Patent: Aug. 19, 2008

(54) APPARATUS AND METHOD FOR IMPROVING SKI JUMP SAFETY

(76) Inventor: David Thomas Crichton, 1077 Bravar Drive, Manotick, Ontario (CA) K4M 1G3

( * ) Notice: Subject to any disclaimer, the term of this patent is extended or adjusted under 35 U.S.C. 154(b) by 197 days.

(21) Appl. No.: 11/342,219

(22) Filed: Jan. 30, 2006

(65) Prior Publication Data

US 2006/0187019 A1 Aug. 24, 2006

(30) Foreign Application Priority Data

Feb. 7, 2005 (CA) ..... 2496323

(51) Int. Cl.
*G08B 21/00* (2006.01)

(52) U.S. Cl. ..... 340/540; 340/522; 340/556; 340/686.1; 702/158; 280/11; 280/11.36; 280/617

(58) Field of Classification Search ..... 340/540, 340/500, 522, 556, 573.1, 686.1; 702/158, 702/157, 159; 280/11, 11.36, 617
See application file for complete search history.

(56) References Cited

U.S. PATENT DOCUMENTS 4,089,057 A 5/1978 Eriksson

FOREIGN PATENT DOCUMENTS

FR 2706317 12/1994
JP 2004-295714 A * 10/2004

* cited by examiner

*Primary Examiner*—Jeff Hofsass
*Assistant Examiner*—Sisay Yacob

(57) ABSTRACT

An apparatus and method for the improving of ski jump safety comprises a first detector for detecting a skier entering a jump site, wherein the first detector produces a first signal, a second detector for detecting the skier exiting the jump site, wherein the second detector produces a second signal, a processor for processing the first signal and the second signal, wherein the processor produces a message signal, and a communicator for communicating the message signal to a next skier. Also, an apparatus and method for the improving of ski jump safety comprises an exit detector for detecting a skier exiting a jump site, wherein said exit detector produces an exit signal, and a signaller for signalling said exit signal to a next skier.

17 Claims, 3 Drawing Sheets

18

APPARATUS AND METHOD FOR IMPROVING SKI JUMP SAFETY

FIELD OF INVENTION

The present invention relates to an apparatus and method for improving the safety of ski jump sites.

BACKGROUND OF THE INVENTION

Over the past fifteen years, a number of mountain sports—primarily downhill skiing and snowboarding, but also ski boarding, telemark skiing and others—have seen tremendous increases in the number of new participants in the youth and young adult age categories, which has forced ski centres to modify their terrain offerings to satisfy this growing market. One aspect of ski centre terrain modification has been the creation of the "terrain park". Terrain parks, which comprise a variety of elements including jumps, spines, halfpipes, quarterpipes, boxes and handrails, among others, are commonplace at most North American resorts today, and vary in size from just a few elements to approximately one hundred elements per park. With the exception of the handrails and boxes, almost all terrain park elements are built entirely from snow. In some cases, ski centres may have individual elements outside of a designated terrain park in random locations on ski trails. In other cases, ski centres may have officially-sanctioned freestyle aerial sites, from which skiers train in various competitive freestyle disciplines. The common thread for ski resorts that have terrain parks, random elements and/or freestyle aerial sites is that they almost always contain jumps of some shape or form.

With respect to specific jumps and jump sites as a whole, the most common form is that of the "table top". Table tops essentially comprise a takeoff, a flat "table" area in the middle, and a landing. Other jump sites that are common in terrain parks and that are similar to table top jumps include "big air" jumps and "gap" jumps. Sometimes, rails, boxes or other features are incorporated into a jump site. On freestyle aerial sites, the jumps are known as either "floaters" or "kickers".

Depending on the jump size, skiers, snowboarders, ski boarders, telemarkers and other mountain enthusiasts (hereinafter collectively "skiers") catch varying degrees of air from the jumps. Often, these jumps are considerably large and can supply a skier with over 50 feet of air. Further, because the takeoff structures are usually somewhat tall, and the respective landing areas located below a knoll, a skier who is uphill and waiting to use the jump will not be able to see whether the preceding skier has vacated the landing area. As a result of crashing skiers, as well as uninformed terrain park users who wander into inappropriate locations, it is common that skiers do not vacate landing areas quickly. Accordingly, a skier who unknowingly proceeds to use a jump despite there still being someone in the landing area may collide with that person and cause serious injury or death to that person and/or themselves.

Although U.S. Pat. No. 4,089,057 and French Patent No. 2,706,317 deal with automated detection systems in relation to skiers, up until now, there has never been an automated means for improving the safety surrounding ski jump sites. At certain high-traffic ski centres across North America, terrain parks have been staffed with employees who act as "spotters" for jump users. These spotters position themselves on the jump site in a suitable location so as to see whether the landing area is clear and safe for the next skier. In the event that the landing area is not clear, the spotter will signal to the skiers who are uphill from the jump site to wait until the landing area has been cleared, at which time the spotter will provide an "all-clear" signal. Unfortunately, very few ski centres have the resources to employ such spotters. Similarly, those resorts that do employ spotters often are not able to afford to supply a spotter for each of the many jumps throughout their respective terrain parks. Further, spotters are human, and as such may be distracted or fail to pay attention while a jump is in use, thus creating the potential for a serious accident.

There is, thus, a need for an automated system that improves the safety surrounding ski jumps.

BRIEF SUMMARY OF THE INVENTION

According to a first aspect of the present invention there is provided an apparatus for the improving of ski jump safety comprising a first detector for detecting a skier entering a jump site, wherein said first detector produces a first signal, a second detector for detecting said skier exiting said jump site, wherein said second detector produces a second signal, a processor for processing said first signal and said second signal, wherein said processor produces a message signal, and a communicator for communicating said message signal to a next skier.

According to a second aspect of the present invention there is provided an apparatus for the improving of ski jump safety comprising an exit detector for detecting a skier exiting a jump site, wherein said exit detector produces an exit signal, and a signaller for signalling said exit signal to a next skier.

According to a third aspect of the present invention there is provided a method for the improving of ski jump safety which comprises detecting a skier entering a jump site through use of a first detector, wherein said first detector produces a first signal, detecting said skier exiting said jump site through use of a second detector, wherein said second detector produces a second signal, processing said first signal and said second signal through use of a processor, wherein said processor produces a message signal, and communicating said message signal to a next skier through use of a communicator.

According to a fourth aspect of the present invention there is provided a method for the improving of ski jump safety which comprises detecting a skier exiting a jump site through use of an exit detector, wherein said exit detector produces an exit signal, and signalling said exit signal to a next skier through use of a signaller.

The advantage of the present invention is that it addresses the safety concerns surrounding a jump landing area that has not been cleared for a next skier.

The present invention will be better understood from the following description and from the accompanying drawings.

DETAILED DESCRIPTION OF THE INVENTION

The apparatuses and methods are now described in greater detail, with reference to the accompanying drawings.

Figure 1:
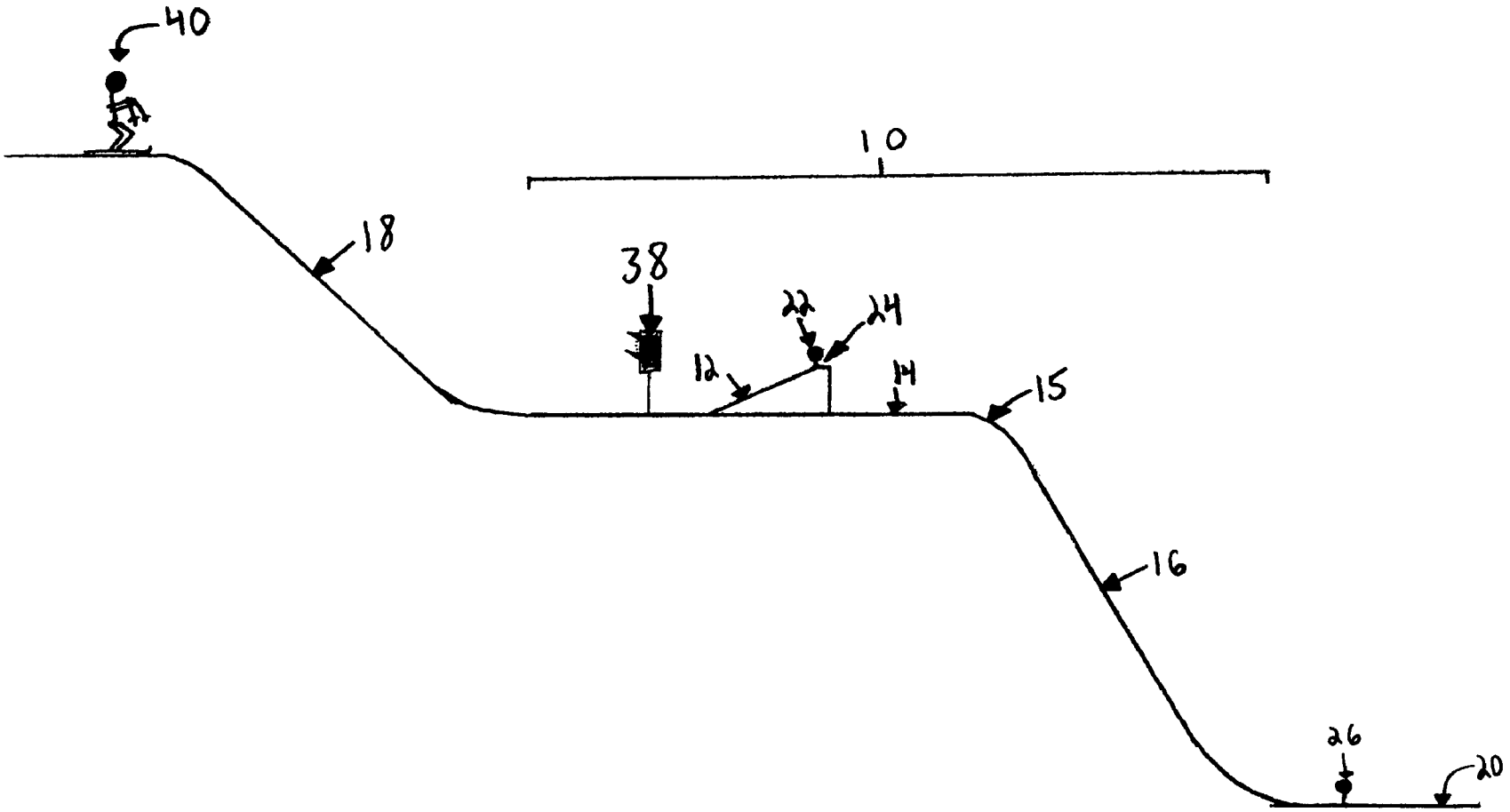
FIG. 1 is side-view of a jump site, in-run and out-run with the apparatus of the invention provided thereon.

Referring to FIG. 1, each jump site 10 consists of a takeoff 12, lip 24, mid-section or table 14, knoll 15 and landing area 16. As well, preceding the jump site 10 is an in-run 18, and following the jump site 10 is an out-run 20. A first detector 22 is preferably located at about the lip 24 of the takeoff 12. A second detector 26 is preferably located beyond the landing area 16 and about at the beginning of the out-run 20.

Figure 2:
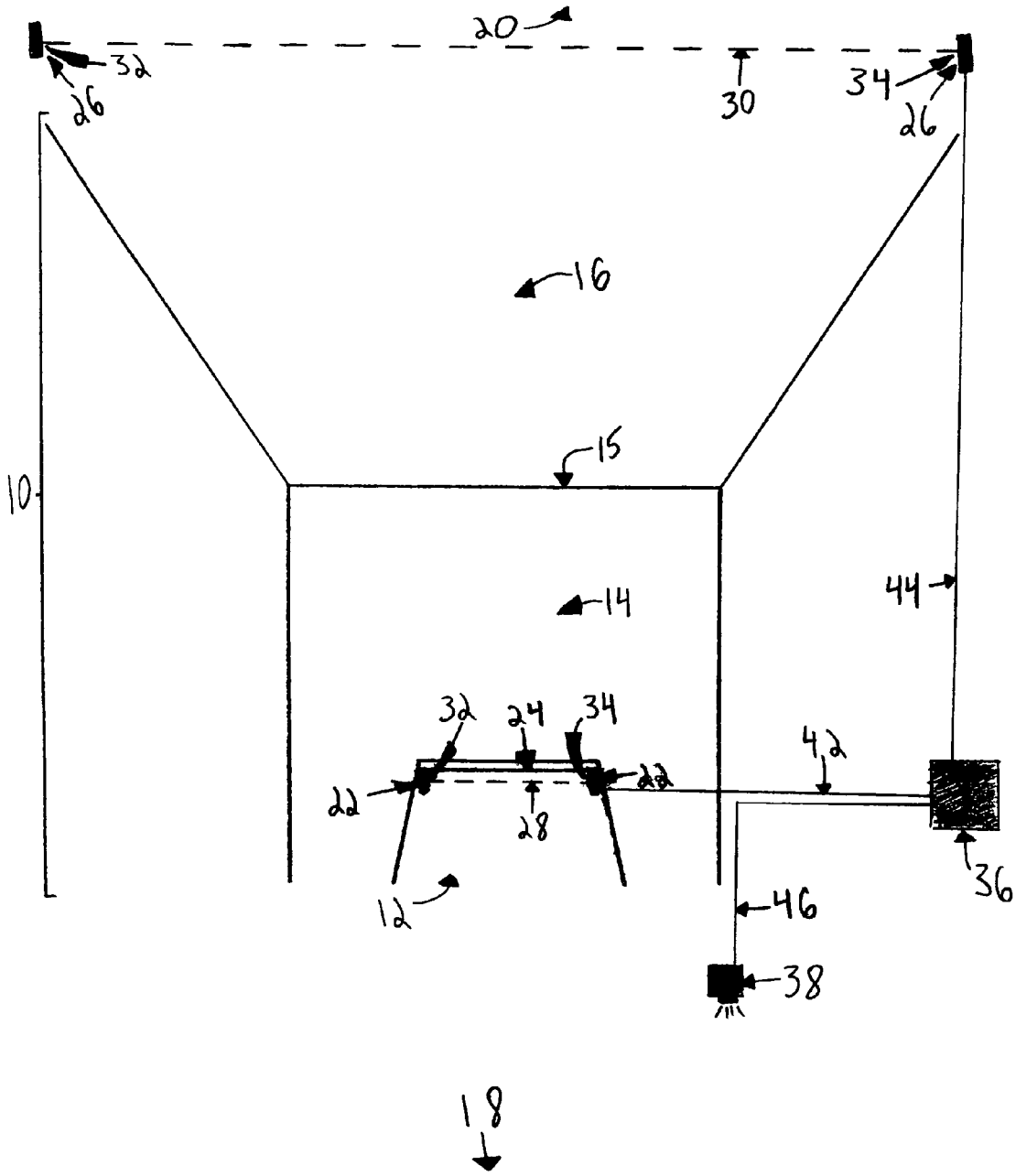
FIG. 2 is a bird's-eye view of the jump site of FIG. 1.

Referring to FIG. 2, the first and second detectors 22, 26 are capable of detecting the passage of a skier through the jump site 10. According to a preferred embodiment of the present invention, the first and second detectors 22, 26 each create respective infrared barriers 28, 30. (Other technology for detecting the passage of a skier is known by one skilled in the art.) Each detector 22, 26 provides an emitter 32 and a receiver 34. When a skier who is using the jump site 10 breaks the infrared barrier 28 produced from the first detector 22, a first signal (not shown) is produced. Upon landing on the landing area 16 and skiing downhill into the out-run 20, the skier will break the infrared barrier 30 produced by the second detector 26, which will in turn produce a second signal (not shown). These first and second signals can each be in the form of a pulse.

Although the first detector 22 could be located at a variety of different locations on the takeoff 12, it is preferred that it is situated at the lip 24, as skiers inspecting the jump site 10 who are not actually catching air may climb up on the takeoff 12 and inadvertently affect the proper functioning of the first detector 22 if it is not positioned at the lip 24. Similarly, the second detector 26, which could be located at a variety of different locations on the landing area 16, is best situated at the beginning of the out-run 20, as it is most likely to properly perform its function once skiers have travelled all the way to the out-run 20, and not simply across just a portion of the landing area 16.

The first and second signals are transmitted to a processor 36 for processing. When the processor 36 receives any signal, it processes that signal and produces a message signal (not shown). This message signal is then sent to a communicator 38 for communicating the message signal to a next skier 40. The communicator 38 may consist of any appropriate form of visual communication. A simple form of communication such as a traditional traffic light having red and green signal lamps is preferred. Whatever the exact form of the communicator 38, it ought to be able to provide a signal that will be visible outdoors where, on numerous occasions, heavy snow and blinding sunlight make visibility difficult. Although not shown in FIG. 2, the processor 36 and the communicator 38 may physically be together as one object such that the first and second signals are sent directly to one physical location for eventual communication to a next skier 40.

Under the present embodiment, the processor 36 produces a particular message signal once it receives a first signal from the first detector 22. Preferably, this particular signal produces a red light with regards to the communicator 38. This red light signals to the next skier 40 that the jump site 10 is in use and that it is not safe to proceed. Once the second detector 26 produces a second signal, the processor 36 produces a different message signal, which, preferably, results in a green light being produced by the communicator 38. The green light signals to the next skier 40 that the jump site 10 is no longer in use and that it is safe to proceed. The advantage of having either a "red" or a "green" message signal being communicated is that at any given time a next skier 40 will be aware of whether or not it is safe to proceed. This continuous communication to a next skier 40 is achieved by having the message signal, regardless of whether it is in a "red" or "green" state, also be a continuous signal. In other words, the communicator 38 produces a solid and continuous display of the message signal.

The transmitting of the first and second signals from the first detector 22 and second detector 26, respectively, to the processor 36, can be achieved via hard wire 42, 44, or via wireless communication using well-known technology (not shown). Likewise, the transmitting of the message signal from the processor 36 to the communicator 38 may be achieved via a hard wire 46 or via wireless communication (not shown).

Figure 3:
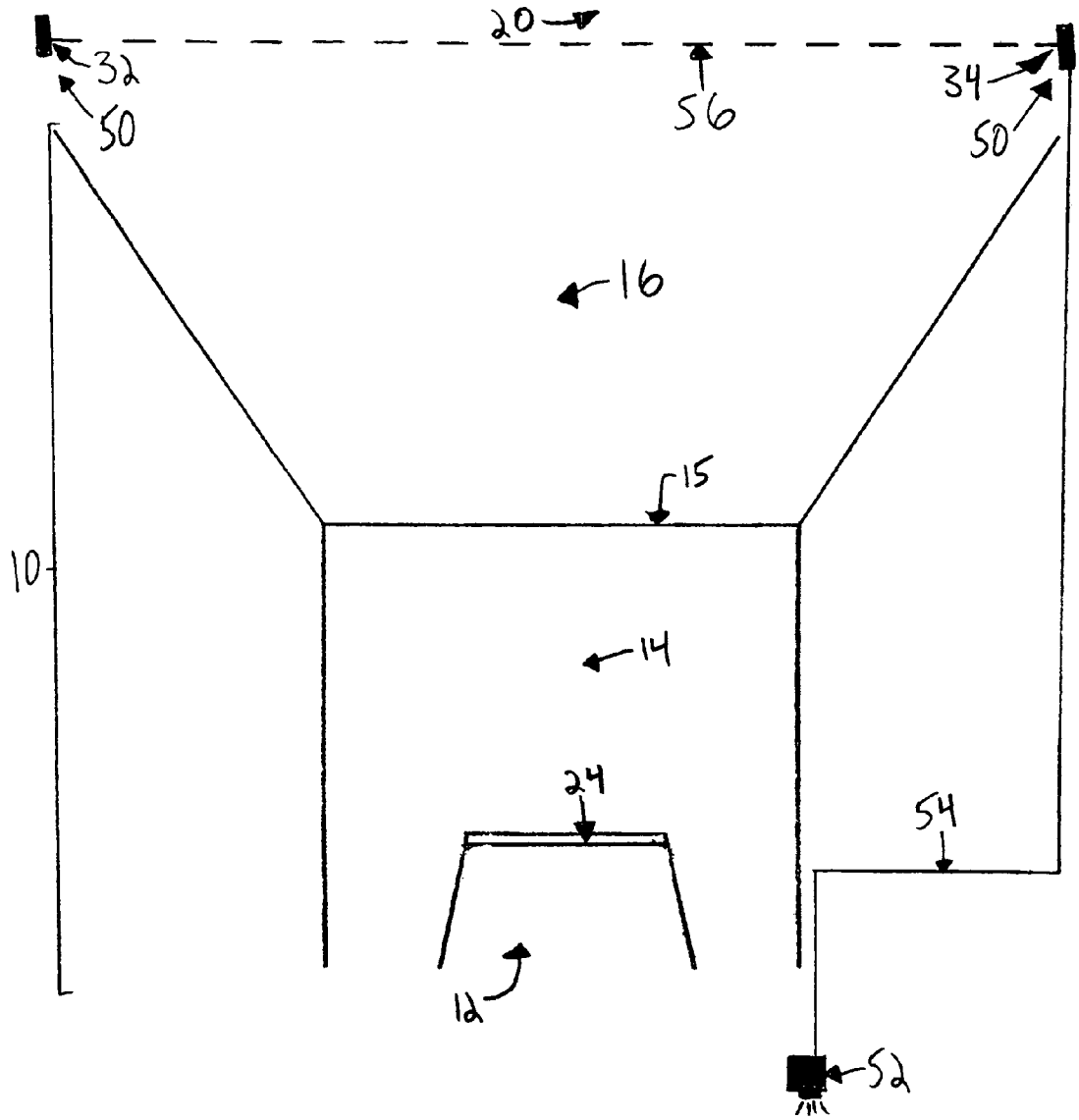
FIG. 3 is a bird's-eye view of a jump site with an alternative embodiment of the present invention provided thereon.

According to another embodiment of the present invention (FIG. 3), there is provided only one detector in the form of an exit detector 50. The exit detector 50 provides an emitter 32 and a receiver 34, which in turn provide an infrared barrier 56. Upon landing on the landing area 16 and skiing downhill into the out-run 20, a skier will break the infrared barrier 56 produced by the exit detector 50, thereby producing an exit signal (not shown). The exit signal is transmitted, either via hard wire 54 or wireless communication (not shown) as described above, to a signaller 52 for processing and signalling to a next skier 40. Preferably, the signaller under this embodiment will have one form of visual communication, namely, a green signal lamp, and will only be displayed for a short period of time (i.e., approximately five seconds), as it would be inappropriate for a green signal to continue to be illuminated while a next skier 40 is entering or is inside a jump site 10.

This alternative embodiment, which uses only an exit detector 50, achieves the desired result of providing improved safety on ski jump sites 10, as it communicates to a next skier 40 the status of whether a preceding skier has exited the landing area 16. Although a next skier 40 is not provided with an "in-use" signal regarding the jump site 10, a safety-critical signal as to whether the skier has departed the jump site 10 is nevertheless provided in the exit signal. In practice, this embodiment is best implemented where there is continuously a next skier 40 who is monitoring the signaller 52.

Other aspects of the present invention that are desirable include appropriate traffic management of the jump site 10. This includes items such as fences (not shown) for ensuring non-jumping traffic stay clear of the landing area 16 and the corresponding second detector 26 or exit detector 50, as the case may be, so as to not complicate the transmitting of signals. Also important is the ability for an authorized employee or volunteer, such as a ski patrol, to deactivate the apparatuses in the event that, for example, the ski jump site 10 becomes crowded due to the evacuation of an injured skier or a ski jump competition is being hosted on the ski jump site. Such a deactivation could be accomplished via the actuating of a switch (not shown) on the processor 36, the signaller 52, the communicator 38 and/or a detector 22, 26, 50, as the case may be, and could result in the continuous display of either a red or green signal, or no signal, as the case may be.

With regards to powering the detectors 22, 26, 50, the processor 36, the communicator 38 and the signaller 52, as the case may be, a person skilled in the art would appreciate that there exist a variety of means for accomplishing this. One possible means would be through the use of batteries in each of the components. Another possible means would be through solar power. Yet another means would be via cable connection to the ski resort's own regular power supply. These possibilities are not exhaustive.

With regards to the construction and physical characteristics of the detectors 22, 26, 50, the processor 36, the communicator 38 and the signaller 52, as the case may be, each will have to be durable enough to withstand not only cold temperatures but also harsh wind, snow, rain and other forms of precipitation. Furthermore, they must be attached to appropriate posts (not shown) wherein the posts are securely planted in the snow so as to hold the respective component in place. Given the existing technology in nordic ski jumping sites and alpine race timing systems, one skilled in the art would have little difficulty in locating appropriate supplies.

While particular embodiments of the present invention have been shown and described, changes and modifications may be made to such embodiments without departing from the true scope of the invention.

What is claimed is:

1. An apparatus for the improving of ski jump safety comprising:

a first detector for detecting a skier entering a jump site, wherein said jump site contains a jump lip and a landing area, and said first detector is positioned at said jump lip and produces a first signal upon said skier entering said jump site;

a second detector for detecting said skier exiting said jump site, wherein said second detector is positioned downhill of said landing area and produces a second signal following said skier's exit of said landing area of said jump site;

a processor for processing said first signal and said second signal, wherein said processor produces a message signal; and, a communicator for communicating said message signal to a next skier.

2. The apparatus according to claim 1, wherein the first and second detectors each contain an infrared emitter and receiver thereby producing respective infrared barriers.

3. The apparatus according to claim 1, wherein the first and second signals are pulses.

4. The apparatus according to claim 1, wherein the communicator displays the message signal as either a green light or a red light.

5. The apparatus according to claim 4, wherein the communicator displays the green and red lights such that they are visible in poor visibility conditions.

6. The apparatus according to claim 1, wherein the signals are transmitted via hard wire connection.

7. The apparatus according to claim 1, wherein the signals are transmitted via wireless communication.

8. An apparatus for the improving of ski jump safety comprising:

a detector positioned at a jump lip for detecting a skier and producing a first signal upon said skier entering a jump site;

an exit detector for detecting a skier exiting said jump site, wherein said jump site contains a landing area, and said exit detector is positioned downhill of said landing area and produces an exit signal following said skier's exit of said landing area of said jump site; and, a signaller for signalling said exit signal to a next skier.

9. The apparatus according to claim 8, wherein the exit detector contains an infrared emitter and receiver thereby producing an infrared barrier.

10. The apparatus according to claim 8, wherein the exit signal is a pulse.

11. The apparatus according to claim 8, wherein the signaller displays the exit signal as either a green light or no light.

12. The apparatus according to claim 11, wherein the green light is displayed for approximately five seconds.

13. The apparatus according to claim 11, wherein the signaller displays the green light such that it is visible in poor visibility conditions.

14. The apparatus according to claim 8, wherein the exit signal is transmitted via hard wire connection.

15. The apparatus according to claim 8, wherein the exit signal is transmitted via wireless communication.

16. A method for the improving of ski jump safety which comprises:

detecting a skier entering a jump site through use of a first detector, wherein said jump site contains a jump lip and a landing area, and said first detector is positioned at said jump lip and produces a first signal upon said skier entering said jump site;

detecting said skier exiting said jump site through use of a second detector, wherein said second detector is positioned downhill of said landing area and produces a second signal following said skier's exit of said landing area of said jump site;

processing said first signal and said second signal through use of a processor, wherein said processor produces a message signal; and, communicating said message signal to a next skier through use of a communicator.

17. A method for the improving of ski jump safety which comprises:

detecting a skier entering a jump site through use of a first detector positioned at a jump lip and producing a first signal upon detecting a skier entering said jump site;

detecting a skier exiting said jump site through use of an exit detector, wherein said jump site contains a landing area, and said exit detector is positioned downhill of said landing area and produces an exit signal following said skier's exit of said landing area of said jump site; and, signalling said exit signal to a next skier through use of a signaller.

* * * * *